US006095246A

United States Patent [19]

Gray et al.

[11] Patent Number: 6,095,246

[45] Date of Patent: Aug. 1, 2000

[54] SAND-BEARING WATER-SOLUBLE STICK AND METHODS OF USE

[76] Inventors: John D. Gray, P.O. Box 188, Hebbronville, Tex. 78361; Matthew M. Walden, 7026 Taos Dr., Corpus Christi, Tex. 78413

[21] Appl. No.: 08/937,031

[22] Filed: Sep. 24, 1997

Related U.S. Application Data

[60] Provisional application No. 60/026,835, Sep. 27, 1996.

[51] Int. Cl.[7] ..... E21B 33/13

[52] U.S. Cl. ..... 166/285; 166/75.15

[58] Field of Search ..... 166/278, 285, 166/51, 75.15

[56] References Cited

U.S. PATENT DOCUMENTS

| | | | |
|---|---|---|---|
| 2,336,168 | 12/1943 | Eckel . | |
| 2,401,035 | 5/1946 | Akeyson et al. . | |
| 4,214,532 | 7/1980 | Oulsnam | 102/30 |
| 5,259,901 | 11/1993 | Davis et al. | 156/154 |
| 5,479,986 | 1/1996 | Gano et al. . | |

OTHER PUBLICATIONS

The Dow Chemical Company, "The Polyglycol Handbook," 1988, Form No. 118–1026–889–AMS.

Christianson Chemicals, Inc., Material Safety Data Sheet and related materials.

*Primary Examiner*—George Suchfield

*Attorney, Agent, or Firm*—George S. Gray

[57] ABSTRACT

A sand-bearing water-soluble stick is provided, which descends rapidly through a column of salt water in a well, allowing the efficient and accurate placement of a column of sand throughout a particular interval of downhole pipe. Methods of use are provided which include sand placement techniques utilizing the stick in typical oil and gas well applications. Sizing and shaping options are provided which assist the user in correlating the sticks to the appropriate piping. In the preferred embodiment, the stick is formed from sand and polyethylene glycol, although the stick can be made with solid materials other than sand, and with other water-soluble bonding agents.

23 Claims, 5 Drawing Sheets

SAND-BEARING WATER-SOLUBLE STICK AND METHODS OF USE

REFERENCE TO PROVISIONAL APPLICATION

Reference is herein made to that provisional application for "A Sand-Bearing Water-Soluble Stick And Methods of Use," Number 60/026,835, filed on Sep. 27, 1996, with regard to which Applicants claim an earlier filing date of Sep. 27, 1996.

BACKGROUND

Our invention relates to the placement of a column of sand in the wellbore of an oil, gas, or other fluid producing well. Such wellbores typically have production casing which is perforated at depths adjacent to producing formations. The conventional well completion will have tubing within the production casing, although current practices include completions which utilize the casing without tubing. Tubingless completions will typically use a smaller internal diameter pipe for the casing.

In a number of applications, in the oil and gas industry, the operator will need to place a sand column over a particular interval in the wellbore, e.g. isolating producing zone perforations in the production casing string, isolating and enhancing the integrity of a bridge plug, temporarily abandoning the well, and other applications. Such a sand column fills the wellbore from one depth to another. These applications will typically involve a column of salt water in the wellbore, the water being used to overcome the formation pressure and keep hydrocarbons from entering the wellbore during the operation.

The salt water typically encountered in these situations include lease water (produced), heavy NaCl brines, fresh water with KCl additives for formation protection, and other solutions with varying densities. Although more exotic solutions have higher densities, e.g. some calcium chlorides, zinc bromides, and calcium Bromide solutions, it remains that, in the vast majority of situations, the wellbore will contain salt water solutions with densities ranging from that of fresh water to about twelve pounds per gallon.

Current methods of placing the sand in the desired wellbore interval primarily involve the use of sand bailers, which are run into the wellbore by wireline. This can be a costly and time-consuming process, depending on the depth of the well, the height of the desired sand column, and other factors. Furthermore, it requires the temporary insertion of substantial hardware into the wellbore, creating an opportunity for mechanical failure and the possibility of lost tools which must be fished at high expense. Without the sand bailer, the operator is limited to dropping sand into the wellbore, although this is very impractical due to possible "bridging" of the sand while descending, as well as, the time required for the unconsolidated sand to descend to the desired depth.

Another method involves pumping a high-viscosity, liquid slurry of sand and polymer, down the tubing into a pressure isolated area adjacent to the production casing perforations. The operator must first fill the tubing with a liquid, typically salt water, and this volume of tubing liquid enters the formation before the slurry reaches its desired position. Such foreign fluid entry into the formation has potentially undesirable effects. After the slurry reaches the desired location, it is allowed to set, and is then pressure tested to see if the perforations are adequately isolated from fluid flow, by the slurry.

Another unsatisfactory method of placing sand is to drop unconsolidated sand into the tubing or casing at the surface.

This is not feasible when the well has surface pressure, and is highly conducive to "bridging" when the sand accumulates at locations higher than the effective bottom of the well.

The ability to quickly place a column of sand in a wellbore, without utilizing the above methods, is very desirable and is the subject of our invention.

SUMMARY OF THE INVENTION

Our invention comprises a carefully constructed composition which we refer to as a "sand stick," which is made of sand, aggregates, or other solid materials, and a water-soluble bonding agent, the water acting as the catalyst for dissolution. The sand stick is solid at standard temperature and pressure, and is shaped to be received by, and move through, the casing or tubing. It will remain a solid during ordinary temperatures encountered at well sites. The stick falls through a column of salt water at a much greater rate than unconsolidated sand, in that the stick has a higher density than the salt water solutions encountered in such operations. As the stick falls, the increasing heat in the wellbore accelerates the dissolution process. The stick will function in both typical and exotic salt water solutions.

Knowing well characteristics, particularly the height of the column of salt water in the well, allows the bonding agent to be chosen such that all, or substantially all, of the sand stick will dissolve before it reaches the bottom of the salt water column. The dissolution process occurs gradually, which allows the stick to descend rapidly through the column. Being water-soluble the dissolved bonding agent goes into solution with the salt water as the stick descends.

Since the operations will usually involve piping of known and standardized internal diameters, the sand stick can also be constructed such that the sand volume per stick will fill a predetermined length of pipe. Various stick sizes can be made which provide the appropriate volume to correspond with American Petroleum Institute Standard pipe sizes, as well as other standardized sizes applicable at the time of use. In the case of larger pipe, this concept can be extended to shaping and sizing the sand stick such that an integer number of sand sticks will fill a linear foot, linear meter or other standard unit of length, of the larger pipe. In all such cases, colored dyes or other product indicators such as color-coded product packaging can be utilized to enable the operator to match the appropriately shaped and sized sand stick to a particular standardized pipe size.

Furthermore, the sand thickness used in the stick can be varied depending on the requirements of the operation. A very fine grained sand can be utilized such that, when released, it will act as a low permeability, low porosity cap on the top of a sand column made of coarser sand. Conversely, a coarser sand mesh may be chosen in situations where it is anticipated that the sand column will be removed using a sand bailer.

Tapering or rounding one or more ends of the sand stick is an additional benefit, since the smoother profile of the descending sand stick may provide a more effective descent in some applications.

With our sand stick, a new method for filling an interval of pipe with sand is available which will be useful in numerous oil and gas well operations. For example, an operator will typically, need a column of sand to cover the production casing interval from depths below and above a set of perforations. The sand column isolates the perforations while other activities, such as the addition of additional perforations, are conducted at higher locations in the wellbore. In the new method of placing the column of sand, the operator places a number of sand sticks in the tubing, or in casing if no tubing is present within the casing. The number of sticks received by such tubing or casing will be chosen such that the volume of the sand is sufficient to fill the production casing from the effective well bottom to a predetermined point above the top of the perforations. The effective well bottom can be the well's total depth, the well's total depth topped or plugged back in previous activities by formation sand, cement, etc., or a bridge plug. As a precaution the operator may wait some length of time following the insertion of the sand sticks, to ensure that substantially all of the sand has fallen into place. As a further precaution, the operator can determine the exact location of the top of the sand column by "tagging" it with either the tubing or a wireline device. This can also be done at the beginning of the operation to confirm the anticipated depth of the effective well bottom. The bonding agent in the sand stick which is utilized in this method will be chosen such that the stick will dissolve prior to reaching the effective bottom of the well, while the sand will descend to the desired depth significantly faster than unconsolidated sand, as a result of the high initial density of the sand stick.

In this example, since the primary purpose of isolating the perforations is to prevent fluid communication between the perforations and the wellbore interval above the perforations, it is sometimes desirable to enhance the sand column effectiveness by "capping" the sand column with a relatively short interval of finer mesh sand. The lower permeability and porosity in this interval will provide additional resistance to fluid communication through the column. When this is desired the method for isolating perforations would also include the step of dropping a small number of sand sticks containing a much finer sand, immediately or soon after the other sticks were dropped.

Further industry utilization of our sand stick will occur in those operations where a bridge plug's sealing integrity is bolstered by placing a sand column on top of the plug. In the event the plug is retrievable and an up-hole cementing operation is involved, the sand column also isolates the plug from the cement, making it much easier to remove after the up-hole operations are completed.

If applicable, the sand stick can be used with analogous results in fresh water.

In some operations the pressure in the wellbore at the surface will dictate the use of procedures and equipment to control such pressure during the placement of the sand sticks. A sand stick insertion device is utilized, which has a top and bottom valve, the valves allowing the isolation of one or more sand sticks from the atmosphere and the pressured pipe at the surface. After the stick is isolated, the insertion device bottom valve is opened allowing the sand stick to be received by the tubing or casing. We have also provided procedures and techniques for the situation where the opening of the insertion device bottom valve is complicated by a large pressure differential between the well and the insertion device interior. In this situation, a pressure equalization line establishes fluid communication between the well and the insertion device interior, which allows the valve to be opened smoothly. Once the stick has entered the well and the insertion device bottom valve has been closed, a pressure release valve is provided which reduces the pressure within the insertion device interior to atmospheric pressure.

According to one embodiment, there is provided a sand-bearing water-soluble composition, comprising: sand; and a water-soluble bonding agent, the combination of the sand and the bonding agent being a solid at standard temperature and pressure, the combination being such that it may be received into and through a length of pipe in a hydrocarbon producing well.

According to a further embodiment, the shape, solubility and density of the composition is such that the composition will descend through a column of fresh water in the pipe at a higher rate than the sand alone.

According to a further embodiment, the shape, solubility and density of the composition is such that the composition will descend through a column of salt water in the pipe at a higher rate than the sand alone.

According to a further embodiment, the molecular weight of the bonding agent is such that the composition will substantially dissolve before reaching the bottom of a column of fresh water in the pipe.

According to a further embodiment, the molecular weight of the bonding agent is such that the composition will substantially dissolve before reaching the bottom of a column of salt water in the pipe.

According to a further embodiment, the composition is in the form of a stick having a length and a generally circular cross-section perpendicular to the length.

According to a further embodiment, the stick has a tapered end.

According to a further embodiment, the stick has a rounded end.

According to a further embodiment, the bonding agent is polyethylene glycol.

According to a further embodiment, the composition is sized such that the volume of sand deposited approximately fills a predetermined length of the piping.

According to a further embodiment, the magnitude of the predetermined length of the piping filled is approximately an integer.

According to a further embodiment, the composition is colored to correspond with a particular size or grade of the pipe.

According to a further embodiment, the composition is marked to correspond with a particular size or grade of the pipe.

According to a further embodiment, the composition is sized such that the volume of sand deposited approximately fills a linear foot of the piping.

According to a further embodiment, the composition is sized such that the volume of sand deposited approximately fills a linear unit of measure of the piping.

According to a further embodiment, the composition is sized such that the number of sticks dropped, multiplied by an integer, will provide a volume of sand sufficient to fill approximately one linear foot of the piping.

According to a further embodiment, the composition is sized such that the number of sticks dropped, multiplied by an integer, will provide a volume of sand sufficient to fill approximately one linear unit of measure of the piping.

According to a further embodiment, the sand bulk volume is approximately double that of the bonding agent volume prior to combination.

According to one embodiment, there is provided for piping having an interval of fresh water or salt water a device for depositing sand at the bottom of the interval of water, comprising sand and a water-soluble bonding agent, bonding the sand, the device being shaped such that the device may be received into and through a length of the piping.

According to a further embodiment, the molecular weight of the bonding agent is such that the device will descend through the water at a higher rate than the sand alone.

According to a further embodiment, the molecular weight of the bonding agent is such that the bonding agent will substantially dissolve before reaching the bottom of the interval of water.

According to one embodiment, there is provided for piping having an interval of fresh water or salt water a device for depositing solid material at the bottom of the interval of water, comprising a solid material and a water-soluble bonding agent, bonding the solid material, the device being shaped such that the device may be received into and through a length of the piping.

According to a further embodiment, the molecular weight of the bonding agent is such that the device will descend through the water at a higher rate than the solid material alone.

According to a further embodiment, the molecular weight of the bonding agent is such that the bonding agent will substantially dissolve before reaching the bottom of the interval of water.

According to one embodiment, there is provided a method of filling a portion of a downhole pipe with sand, in a hydrocarbon or other fluid producing well, where the interior of such downhole pipe is in fluid communication with the interior of a receiving pipe at the surface, where fresh water or salt water fills all or part of the well interval between the downhole pipe and the receiving pipe, and the portion of the downhole pipe which is to be filled with sand, and where an effective well bottom determines the lower depth of the portion of the downhole pipe to be filled with sand, the improvement, comprising: placing a plurality of sand-bearing water-soluble sticks in the interior of the receiving pipe; and waiting for the sticks to descend, dissolve and deposit the sand on the effective well bottom.

According to a further embodiment, the effective well bottom is the effective total depth of the well at the time the sand placement operation begins.

According to a further embodiment, the effective well bottom is the top of a bridge plug set in the downhole pipe.

According to a further embodiment, the apparatus further comprises the additional step of placing a second plurality of sticks in the receiving pipe following the first plurality of sticks, the second plurality of sticks having a substantially finer mesh sand.

According to a further embodiment, the shape, solubility and density of the sand-bearing water-soluble sticks are such that the sticks are completely or substantially dissolved before reaching the intended depth of the top of the pipe interval to be filled.

According to a further embodiment, the shape, density and solubility of the sand-bearing water-soluble sticks are such that the sticks will descend through a column of salt water at a higher rate than the unconsolidated sand.

According to a further embodiment, the sand-bearing water-soluble sticks are formed by combining sand with polyethylene glycol.

According to a further embodiment, the step of placing the plurality of sand-bearing water-soluble sticks in the receiving pipe further comprises: attaching a stick insertion device to the well, the stick insertion device having a top valve, a middle portion having an interior for holding one or more sticks, and a bottom valve, the valves being sized for receiving the sticks when open, the insertion device being attached to the well such that the insertion device middle portion interior is in fluid communication with the interior of the receiving pipe when the bottom valve is open; separating the interior of the receiving pipe from the insertion device middle portion by closing the insertion device bottom valve; opening the insertion device top valve; inserting one or more sticks through the insertion device top valve into the insertion device middle portion interior; closing the insertion device top valve; opening the insertion device bottom valve, allowing the stick or sticks within the insertion device middle portion to fall into the interior of the receiving pipe; and repeating all post-insertion device attachment steps for additional sticks.

According to a further embodiment, the step of placing the plurality of sand-bearing water-soluble sticks in the receiving pipe further comprises: (a) isolating pressure from the receiving pipe interior from the surface by closing a receiving pipe valve located on or above the receiving pipe; (b) attaching a stick insertion device to the well, the stick insertion device having a top valve, a middle portion having an interior for holding one or more sticks, and a bottom valve, the valves being sized for receiving the sticks when open, the insertion device being attached such that the insertion device middle portion interior is in fluid communication with the interior of the receiving pipe when the bottom valve is open; (c) connecting the insertion device middle portion interior to the receiving pipe interior with a pressure equalization line, the pressure equalization line having a pressure equalization valve whereby such connection is closed when the pressure equalization valve is closed; (d) closing the pressure equalization valve; (e) separating the interior of the receiving pipe from the insertion device middle portion by closing the insertion device bottom valve; (f) opening the insertion device top valve, if closed; (g) inserting one or more sticks through the insertion device top valve into the insertion device middle portion interior; (h) closing the insertion device top valve; (i) opening the receiving pipe valve such that a pressure differential is created across the insertion device bottom valve; (i) opening the pressure equalization valve such that the pressure differential across the bottom valve is substantially eliminated; (k) closing the pressure equalization valve; (l) opening the insertion device bottom valve, allowing the stick or sticks within the insertion device middle portion to fall into the interior of the receiving pipe; (m) closing the insertion device bottom valve; (n) reducing the pressure within the insertion device middle portion to atmospheric pressure; and (o) repeating steps f through n for additional sticks.

According to a further embodiment, the apparatus further comprises a middle portion bleed valve attached to the insertion device middle portion whereby pressure is released from the insertion device middle portion interior when the middle portion bleed valve is open, and further wherein the step of reducing the pressure within the insertion device middle portion to atmospheric pressure is accomplished by opening the middle portion bleed valve, followed by closing the middle portion bleed valve when the pressure has been so reduced.

According to a further embodiment, the connection made in the step of connecting the insertion device middle portion interior to the receiving pipe interior with a pressure equalization line, is indirectly made through other wellhead apparatus.

According to one embodiment, there is provided a method of filling a portion of a downhole pipe having an effective well bottom with sand, where the interior of such pipe is in fluid communication with the interior of a receiving pipe at the surface, where the interiors of the downhole pipe and receiving pipe are connected by a pipe string, where water fills the portion of the downhole pipe which is to be filled and all or part of the connecting pipe string, and where an effective well bottom determines the lower depth of the portion of the downhole pipe to be filled, the improvement, comprising: calculating the number of sand-bearing water-soluble sticks required to fill the desired interval in the downhole pipe; adding one or more sticks to the calculated number, if desired, to accommodate for possible sand loss; placing the above sum of sand-bearing water-soluble sticks in the interior of the receiving pipe; and waiting for the sticks to descend, dissolve and deposit the sand on the effective well bottom.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the shape, solubility and density of the composition being such that the composition will descend through a column of fresh water in the pipe at a higher rate than the unconsolidated sand alone.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the shape, solubility and density of the composition being such that the composition will descend through a column of salt water in the pipe at a higher rate than the unconsolidated sand alone.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the molecular weight of the bonding agent being such that the composition will substantially dissolve before reaching the bottom of a column of fresh water in the pipe.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the molecular weight of the bonding agent being such that the composition will substantially dissolve before reaching the bottom of a column of salt water in the pipe.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the bonding agent being polyethylene glycol.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being sized such that the volume of sand deposited approximately fills a predetermined length of the piping.

According to a further embodiment, the magnitude of the predetermined length of the piping filled is approximately an integer, the length measured in feet or meters.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being colored to correspond with a particular size or grade of the pipe.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being marked to correspond with a particular size or grade of the pipe.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being sized such that the volume of sand deposited approximately fills a linear foot of the piping.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being sized such that the volume of sand deposited approximately fills a linear unit of measure of the piping, the linear unit of measure being either feet or meters.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being stick-shaped and sized such that the number of sticks dropped, multiplied by an integer, will provide a volume of sand sufficient to fill approximately one linear foot of the piping.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the composition being stick-shaped and sized such that the number of sticks dropped, multiplied by an integer, will provide a volume of sand sufficient to fill approximately one linear unit of measure of the piping, the linear unit of measure being either feet or meters.

According to one embodiment, there is provided a sand-bearing water-soluble composition, comprising: sand; and a water-soluble bonding agent, the combination of the sand and the bonding agent being a solid at standard temperature and pressure, the combination being shaped such that it may be received into and through a length of pipe, the sand bulk volume being approximately double that of the bonding agent volume prior to combination.

According to one embodiment, there is provided for piping having an interval of fresh water or salt water a device for depositing sand at the bottom of the interval of water, comprising sand, and a water-soluble bonding agent, bonding the sand, the device being shaped such that the device may be received into and through a length of the piping, the molecular weight of the bonding agent being such that the device will descend through the water at a higher rate than the unconsolidated sand alone.

According to one embodiment, there is provided for piping having an interval of fresh water or salt water a device for depositing sand at the bottom of the interval of water, comprising a sand-bearing water-soluble composition, the sand-bearing water soluble composition comprising sand, and a water-soluble bonding agent, the device being shaped such that the device may be received into and through a length of the piping, the molecular weight of the bonding agent being such that the bonding agent will substantially dissolve before reaching the bottom of the interval of water.

According to one embodiment, there is provided for piping having an interval of fresh water or salt water a device for depositing solid material at the bottom of the interval of water, comprising a solid material, and a water-soluble bonding agent, bonding the solid material, the device being shaped such that the device may be received into and through a length of the piping, the molecular weight of the bonding agent being such that the device will descend through the water at a higher rate than the unconsolidated solid material.

According to one embodiment, there is provided for piping having an interval of fresh water or salt water a device for depositing solid material at the bottom of the interval of water, comprising a solid material-bearing water-soluble composition, the solid material-bearing water-soluble composition comprising a solid material, and a water-soluble bonding agent, the device being shaped such that the device may be received into and through a length of the piping, the molecular weight the molecular weight of the bonding agent is such that the bonding agent will substantially dissolve before reaching the bottom of the interval of water.

According to one embodiment, there is provided a sand-bearing water-soluble composition, comprising: sand; and a water-soluble bonding agent, the combination of the sand and the bonding agent being a solid at standard temperature and pressure, the combination being such that it may be received into and through a length of pipe in a hydrocarbon producing well, the water-soluble bonding agent being polyethylene glycol, the composition further being in the form of a stick having a length and a generally circular cross-section perpendicular to the length.

According to a further embodiment, the stick has a tapered end.

According to a further embodiment, the stick has a rounded end.

According to a further embodiment, the shape, density and solubility of the sand-bag water-soluble sticks are such that the sticks will descend through a column of salt water at a higher rate than unconsolidated sand alone.

DESCRIPTION

Figure 1:
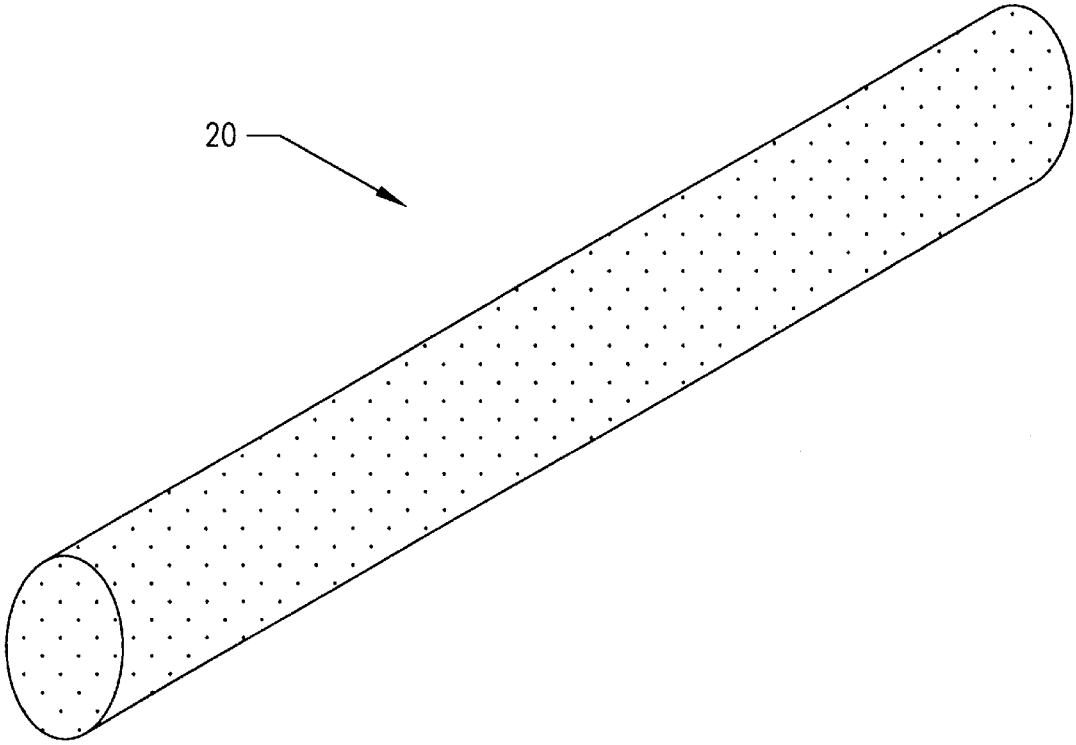
FIG. 1 is an oblique view of the sand stick.
Figure 2:
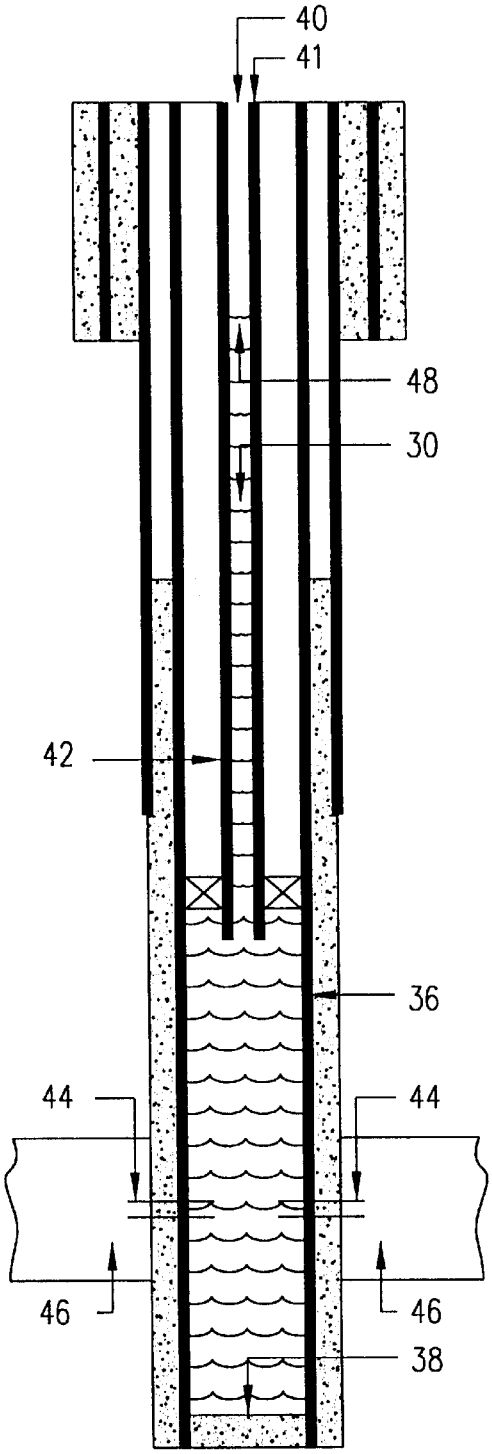
FIG. 2 is an unscaled schematic representation of a conventional well completion, showing the tubing and packer within production casing, as well as, a set of perforations, prior to the placement of a sand column in the wellbore.
Figure 3:
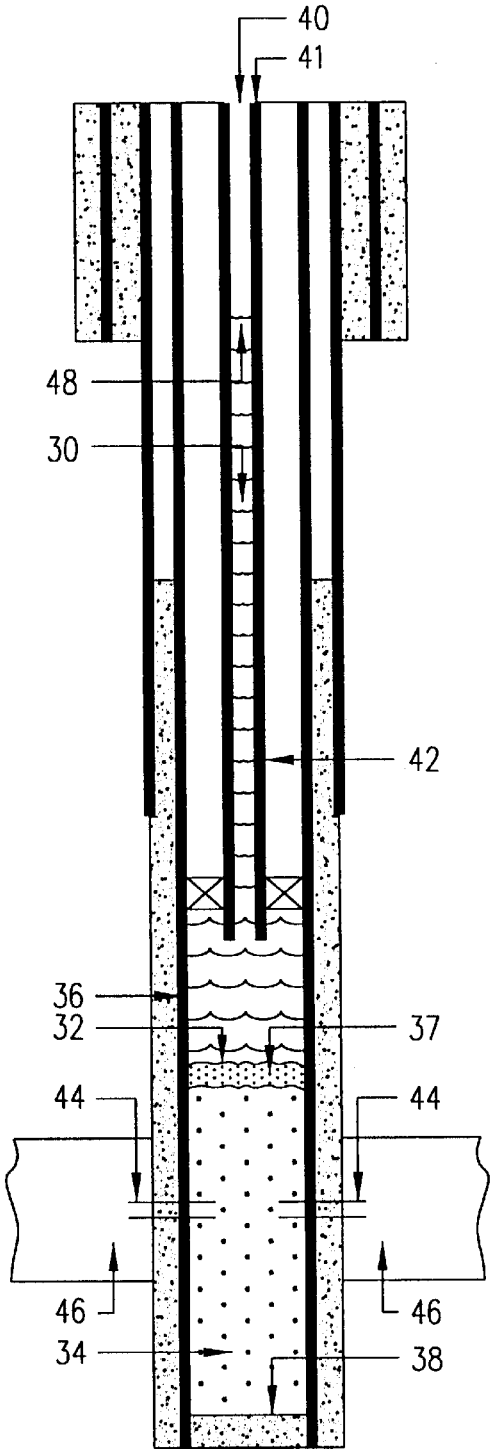
FIG. 3 is an unscaled schematic representation of the conventional well completion in FIG. 2, following the placement of a sand column in the wellbore.

The sand stick 20 is shown in FIG. 1. The dimensions, sand type and type of bonding agent can be adjusted or selected for the particular well application. Our field experience has shown that a 2:1 volumetric blend of 20/40 mesh sand (Tyler) to polyethylene glycol of varying molecular weights forms a sand stick which works effectively in situations where the standing water column is as deep as 16,000 feet. It is anticipated that similar performance can be obtained in deeper wells, as well. In these applications the sand stick preferred shape is circular along its longitudinal axis. The sand stick descended rapidly through much of the column, and completely, or substantially dissolved before reaching the depth of the intended top of the sand column. The initial rate of descension of the sand stick was several times the anticipated descension rate of unconsolidated sand.

The molecular weight of the polyethylene glycol significantly affects the rate at which the sand stick falls through the column, with higher weights causing a more rapid descent. The above field experience has shown that wells in the approximate range of 8,000 to 16,000 feet serve as appropriate applications for a sand stick using polyethylene glycol with approximately 8000 molecular weight (Cosmetic, Toiletry and Fragrance Association "PEG-150"). In these applications, which involved approximately 2.44 inch internal diameter tubing, 3.55 inch internal diameter casing, and 4.09 inch internal diameter casing, the sand stick diameter was 1.75 inches with a length of 24 inches. (These dimensions provided approximately one linear foot of sand column in the tubing application.) In such applications, it was determined that the 1.75 inch sand stick diameter in the 2.44 inch internal diameter tubing, produced an increased likelihood of unwanted accumulations of sand at depths less than the target. It is anticipated that the optimum sand stick diameter for 2.44 inch internal diameter tubing will be approximately 1.5 inches. When this diameter is used the sand stick length is increased to approximately 30 inches, in order to provide an equivalent sand volume.

Our field experience also included a sand stick combining 20/40 mesh sand using polyethylene glycol with approximately 3350 molecular weight (Cosmetic, Toiletry and Fragrance Association "PEG-75") in an approximately 8,000 foot well. In this application, the sand stick, performed satisfactorily, although the amount of time necessary for the sand column to stabilize was significantly increased, due to the stick's dissolution at lesser depths than the heavier stick did under similar circumstances. Other field experience indicates that using polyethylene glycol with approximately 6000 molecular weight (Cosmetic, Toiletry and Fragrance Association "PEG-100") performed satisfactorily in a 10,000 foot well.

From these experiences we conclude that a well having an 8,000 foot salt water column with ordinary downhole temperature gradients, is at the upper end of the range in which PEG-75 is desirable as the bonding agent, i.e. the use of a heavier polyethylene glycol, will produce desirable increases in the rate at which the sand stick descends.

Although a theoretically infinite number of weights could be chosen based on well depth, downhole temperature gradients, operator preferences and scheduling demands, etc., we have determined that the weight selections offered by the sand sticks utilizing PEG-75 and PEG-150 polyethylene glycol will satisfactorily address all typical well applications. The invention contemplates, however, that a number of sand sticks 20 with bonding agents of varying molecular weights, will ultimately be utilized to cover the needs of various oil and gas producing geographical areas.

The invention also contemplates that other water-soluble bonding agents might be substituted, although polyethylene glycol appears optimum among currently known materials. "NONOXYNOL 100" (nonylphenol), for example, is water-soluble, however., it is incompatible with certain hydrocarbons which could, under certain circumstances, lead to unwanted emulsification of downhole fluids.

Current practice utilizing the sand sticks 20 indicates that, in a tubingless completion, it is very useful to shape the stick 20 such that it will fall through 2⅞" outside diameter tubing 76 (2.441" internal diameter), and to size the stick 20 such that the bulk sand volume within will fill one linear foot (or one linear unit of length) of such pipe 76. This assists the operator in making the determination as to the number of sticks 20 required. Other stick 20 sizes can be made which will provide similarly useful correlations to American Petroleum Institute Standard pipe sizes, as well as other standardized sizes, which might be in effect at the time of product application.

Furthermore, our invention includes sand sticks 20 which will have a finer mesh sand in place of the sand which forms the bulk of the sand column 34. A "cap" 37 of this finer mesh sand will reduce the effective permeability and porosity of the sand column 34 with respect to fluid communication across the top 32 of the column 34. It is anticipated that silica flour or 100 mesh sand will provide appropriate reductions, although other sizes may be appropriate under the circumstances.

It is further anticipated that 12/20 mesh sand, or larger, will be useful in some applications, e.g. those in which a sand bailer is used to remove the sand column 34,54,74 after the operation is completed. Similarly, in some applications, various aggregates or conglomerates can be substituted for, or combined with, the sand.

An additional aspect of our invention is a reshaping of one or both ends to provide a tapered rounded profile as it enters the pipe 76. In some applications, it is anticipated that the sand stick 20 will descend more effectively if this is done.

Figure 4:
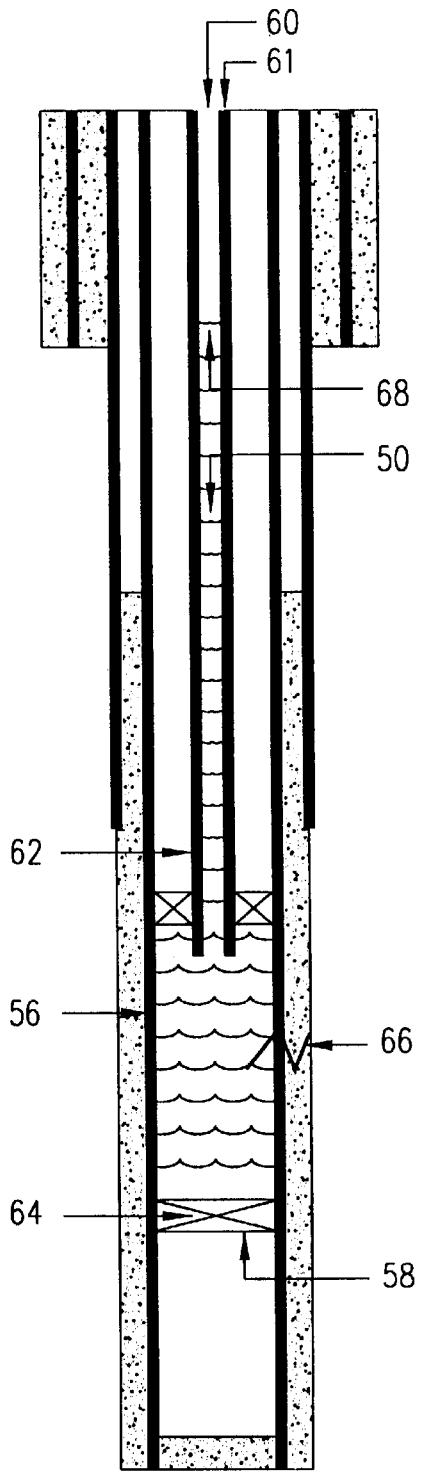
FIG. 4 is an unscaled schematic representation of a conventional well completion, showing the tubing and packer within production casing, as well as, a bridge plug set beneath a casing leak, prior to the placement of a sand column in the wellbore.
Figure 5:
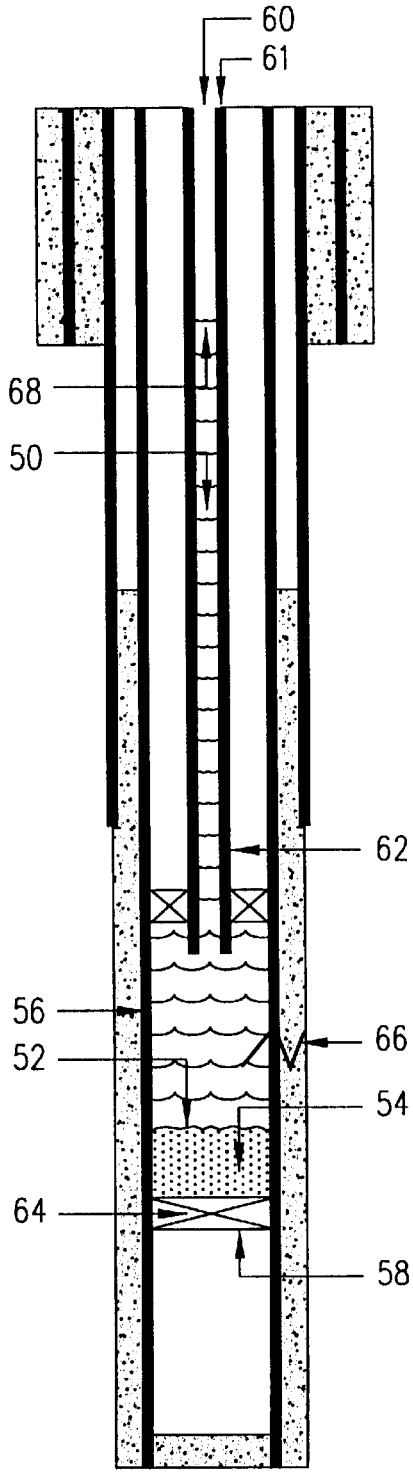
FIG. 5 is an unscaled schematic representation of the conventional well completion in FIG. 4, following the placement of a sand column in the wellbore.
Figure 6:
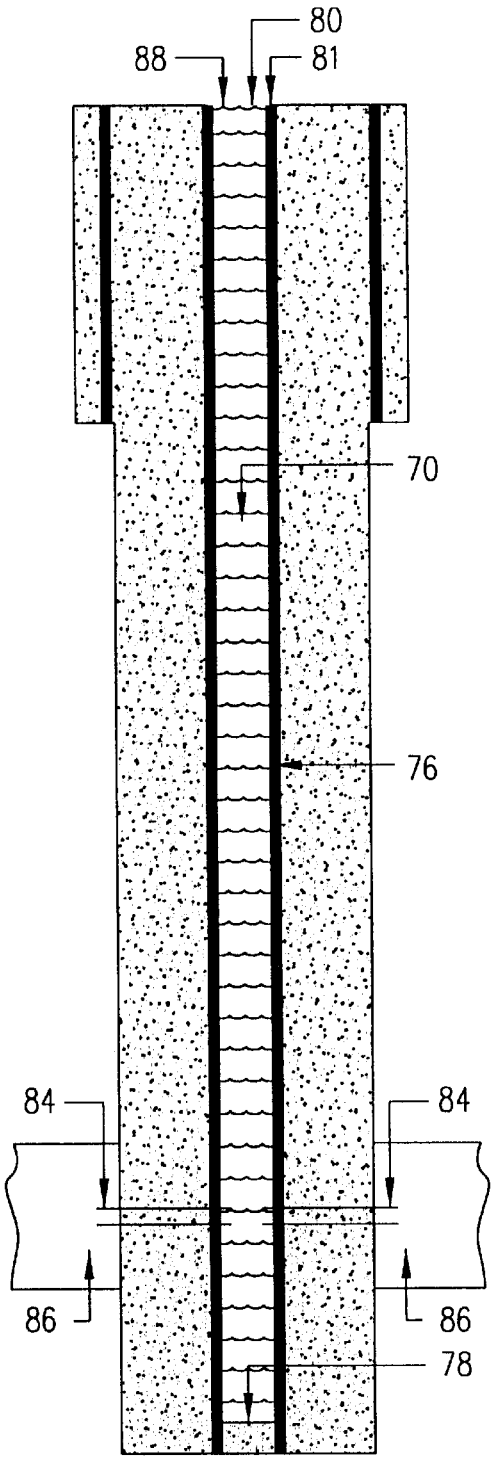
FIG. 6 is an unscaled schematic representation of a tubingless well completion, showing the production casing, as well as, a set of perforations, prior to the placement of a sand column in the wellbore.
Figure 7:
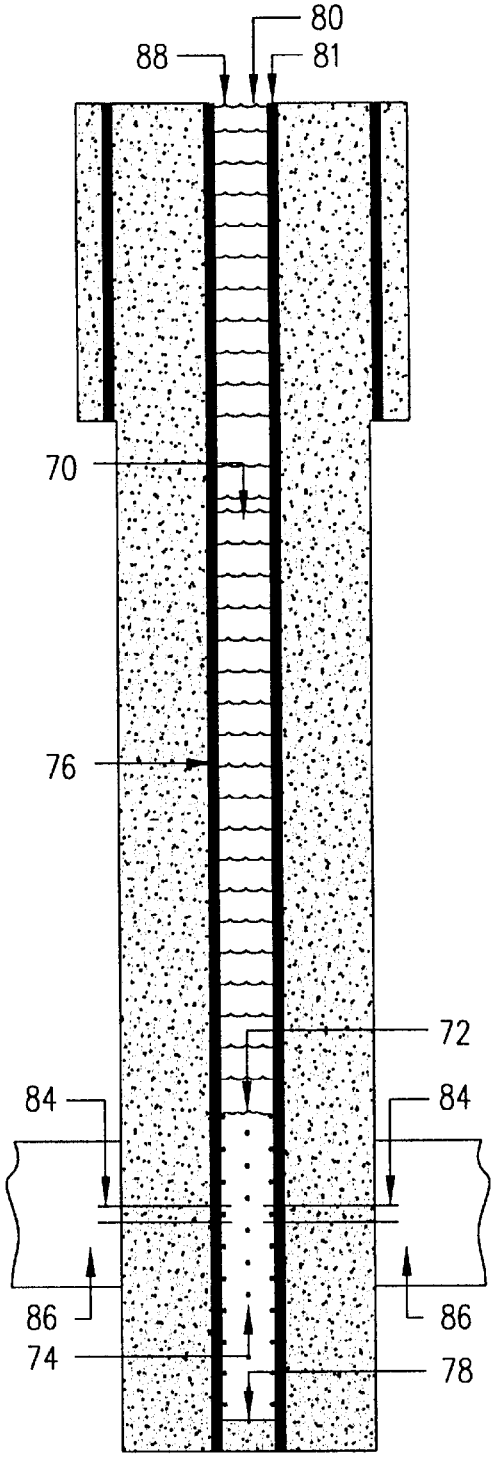
FIG. 7 is an unscaled schematic representation of the tubingless well completion, in FIG. 6, following the placement of a sand column in the wellbore.

The preferred methods of using of the sand stick 20 in various downhole sand placement operations involve a downhole pipe 36,56,76 (e.g. production or intermediate casing) which the operator desires to fill with sand, in an interval extending from a particular bottom depth, i.e., the effective well bottom 38,58,78, to a particular top depth 32,52,72. This downhole pipe 36,56,76 will be in fluid communication with receiving pipe 81 at the surface 80, with no other pipe within it, or the downhole pipe 36,56,76 will be in fluid communication with receiving pipe 41,61 at the surface 40,60 as a result of a continuation pipe 42,62, such as tubing. In either case, the continuation piping 42,62,76 between the downhole pipe 36,56,76 and the receiving pipe 41,61,81 at the surface 40,60,80, has an inside diameter which allows the sand stick 20 to be received into, and pass through and out of, all pipe from the receiving pipe 41,61,81 at the surface 40,60,80 to the effective well bottom 38,58,78. FIGS. 2–5 schematically depict conventional well completions showing fluid communication from the downhole pipe 36,56 through the continuation pipe 42,62 to the surface 40,60. FIGS. 6–7 depict a tubingless completion where the downhole pipe 76 is continuous to the receiving pipe 81 at the surface 80.

Typical operations are reflected in FIGS. 2–3,6–7 where perforations 44,84, through the downhole pipe 36,76 into the formation 46,86, are covered and isolated by the sand column 34,74. FIGS. 4–5 represent a remedial cementing operation configuration where a bridge plug 64 is set beneath a casing leak 66 and a sand column 54 is placed on the bridge plug 64.

In either type of completion the sand column 34,54,74 is formed by placing the sand sticks 20 in the receiving pipe 41,61,81 at the surface 40,60,80 and waiting for the sticks 20 to fall, dissolve and deposit the sand on the effective well bottom 38,58,78. Because the stick 20 has been constructed in a manner that the linear footage filled by each sand stick 20 is known, the operator can calculate the number of sticks 20 to be dropped which will result in a sand column 34,54,74 of desired height. In some wellbore situations, portions of the sand may go into the formation 46,86 outside the downhole pipe 36,56,76, or through a casing leak 66. If this is anticipated by the operator, an additional number of sticks 20 can be dropped to offset the amounts lost.

The performance of the sand sticks 20 will be maximized when the operator determines the height (fluid level) 48,68, 88 of the salt water column 30,50,70, and chooses a sand stick 20 with a molecular weight which is compatible with that column height, such that the sand stick 20 is completely dissolved, or substantially dissolved, prior to reaching the depth desired for the top of the sand column 34,54,74. Similarly, the chosen sand stick 20 will not complete the dissolution process prematurely.

Figure 8:
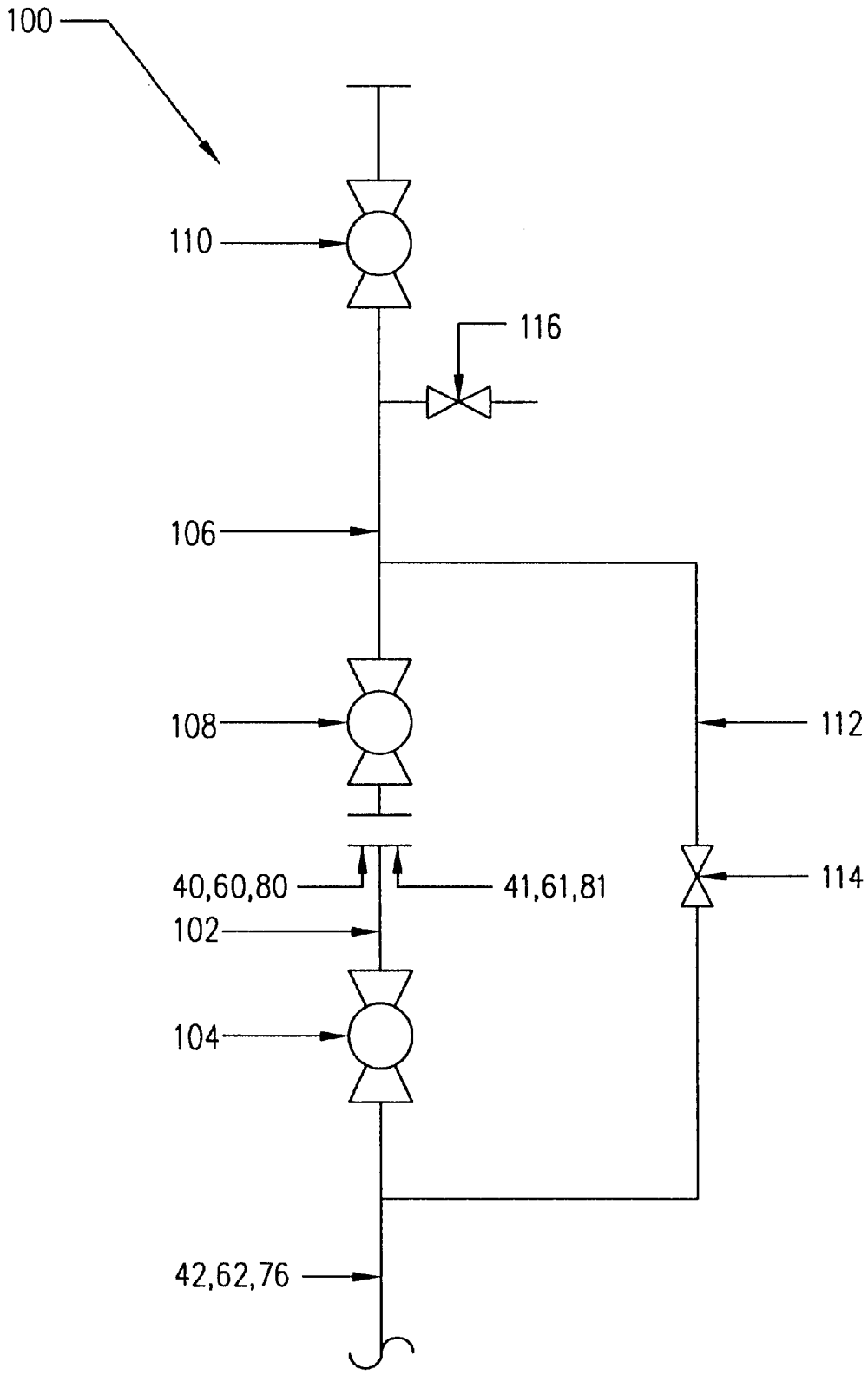
FIG. 8 is a schematic representation of the sand stick insertion device, including means for pressure differential reduction.

In many situations, it will be desirable to attach a sand stick 20 insertion device 100 to the receiving pipe 41,61,81. The important features of such an insertion device 100 are schematically illustrated in FIG. 8. If wellbore 102 pressures result in a pressurized receiving pipe 41,61,81 at the surface 40,60,80, this attachment should take place following the closing of a valve 104 at or near the surface 40,60,80 which will isolate the insertion device 100 from pressures within the receiving pipe 41,61,81. Once the insertion device 100 is installed, the insertion device middle portion 106, shaped to hold one or more sticks 20 in its interior, can be isolated from receiving pipe 41,61,81 pressure by closing the insertion device bottom valve 108. After the insertion device top valve 110 is opened, one or more sand sticks 20 can be placed in the insertion device middle portion 106 through the insertion device top valve 110. The insertion device top valve 110 is then closed and the insertion device bottom valve 108 opened, which allows the stick 20 or sticks 20 to fall from the insertion device middle portion 106 into the interior of the receiving pipe 41,61,81 at the surface 40,60, 80, at which point the sticks 20 begin the descent through continuous piping 42,62,76 to the downhole pipe 36,56,76 interval to be filled by the sand released from the sticks 20 during the dissolution process. This stick 20 insertion procedure is repeated until the desired number of sand sticks 20 have entered the wellbore 102 through the receiving pipe 41,61,81.

If the pressure in the receiving pipe 41,61,81 is large enough, it will create a pressure differential across the insertion device bottom valve 108 which can make it difficult to open. FIG. 8 also depicts pressure differential reduction means which equalizes the pressure across the insertion device bottom valve 108. Such means comprises a pressure equalization line 112, which, by directly or indirectly connecting the insertion device middle portion 106 interior to interior of the receiving pipe 41,61,81, allows such equalization to occur. Other wellhead apparatus may be included in communication with the pressure equalization line 112, such as a pressure gage (not shown), a bleed valve (not shown), etc. The equalization process begins when the sand stick 20 or sticks 20 have been inserted into the insertion device middle portion 106 and the insertion device top valve 110 has been closed, at which point a pressure equalization valve 114 on the pressure equalization line 112 is opened, allowing fluid communication between the interiors of the receiving pipe 41,61,81 and the insertion device middle portion 106. Once the pressure has equalized the pressure equalization valve 114 is closed, and the insertion device bottom valve 108 can be opened and closed, as described above. Pressure remaining in the insertion device middle portion 106 interior can then be bled off to atmospheric pressure, preferably by use of a insertion device middle portion bleed valve 116 attached to the insertion device middle portion 106. However, it is also possible to release such pressure by opening the insertion device top valve 110.

If the operator desires to "cap" the sand column with a finer mesh sand, to reduce the effective permeability and porosity of the sand column 34,54,74, the operator places a second group of sand sticks 20, which have a finer mesh sand, into the interior of the receiving pipe 41,61,81 following the first group of sand sticks 20, using the same procedures, i.e. with or without an insertion device 100 attached.

The molecular weights described can be approximated without severely altering the performance characteristics of the resulting sand sticks 20. They are also approximated to the extent that polyethylene glycol industry nomenclature and specifications are approximated. For example, the molecular weights assigned by The Dow Chemical Company in its publication "The Polyglycol Handbook" (Copyright, 1988; Form No. 118-1026-889-AMS) have, in part, been used herein, and these are stated to be approximates in that publication. In accordance with that publication, the average viscosity for polyethylene glycols having molecular weights from 3350 to 8000 should be from 93 to 800 centistokes. Furthermore, Christianson Chemicals, Inc., in its Material Safety Data Sheet, indicates that for 6000 molecular weight polyethylene glycol (PEG-6000), the average molecular weight varies from 5800–6800. For 8000 molecular weight (PEG-8000) the range stated therein is 7000 to 8600.

Our experience reveals that the best performance of the sand stick is achieved when the stick is made by carefully controlled blending techniques. Without such techniques the sand distribution within the bonding agent will be uneven, which can result in loss of stick integrity, handling difficulties and unsatisfactory dissolution in actual use. Our manufacturing procedure includes a method of making the sticks which enhances the even distribution of sand in the bonding agent. In this method, the bonding agent is heated to approximately 200° F. at which point the sand is added, the ratio of sand to bonding agent volumes being predetermined. The bonding agent is being agitated while the sand is being added, and the resulting slurry is reheated to 200° F. prior to being poured into tubes of predetermined volume, where the slurry solidifies as it cools. The temperatures depend on the molecular weights of the polyethylene glycol being used. Reasonable variations in such temperatures can be tolerated without jeopardizing the basic function of the sand stick, particularly in light of typical fluctuations in the molecular weights of polyethylene glycol and ambient temperatures.

Although the present invention has been described in considerable detail with reference to certain preferred and alternate embodiments thereof, other embodiments are possible. Accordingly, the spirit and scope of the appended claims should not be limited to the description of the embodiments contained herein. Furthermore, the claims submitted with this provisional application are in no manner intended by us to limit the scope of our invention as otherwise disclosed by the remainder of this specification.

What is claimed is:

1. A sand-bearing water-soluble composition, comprising: sand; and a water-soluble bonding agent, the combination of the sand and the bonding agent being a solid at standard temperature and pressure, the combination being such that it may be received into and through a length of pipe in a hydrocarbon producing well the water-soluble bonding agent being polyethlene glycol, the composition further being in the form of a sick having a length and a generally circular cross-section perpendicular to the length.

2. The sand-bearing, water-soluble composition of claim 1, wherein the composition is in the form of a stick having a length and a generally circular cross-section perpendicular to the length.

3. The sand-bearing, water-soluble composition of claim 1, wherein the stick has a tapered end.

4. The sand-bearing, water-soluble composition of claim 1, wherein the stick has a rounded end.

5. In piping having an interval of fresh water or salt water, a device for depositing solid material at the bottom of the interval of water, comprising a solid material and a water-soluble bonding agent, bonding the solid material, the device being shaped such that the device may be received into and through a length of the piping.

6. The device of claim 5, wherein the molecular weight of the bonding agent is such that the device will descend through the water at a higher rate than the solid material alone.

7. The device of claim 5, wherein the molecular weight of the bonding agent is such that the bonding agent will substantially dissolve before reaching the bottom of the interval of water.

8. In the method of filling a portion of a downhole pipe with sand, in a hydrocarbon or other fluid producing well, where the interior of such downhole pipe is in fluid communication with the interior of a receiving pipe at the surface, where fresh water or salt water fills all or part of the well interval between the downhole pipe and the receiving pipe, and the portion of the downhole pipe which is to be filled with sand, and where an effective well bottom determines the lower depth of the portion of the downhole pipe to be filled with sand, the improvement, comprising:

placing a plurality of sand-bearing water-soluble sticks in the interior of the receiving pipe; and waiting for the sticks to descend, dissolve and deposit the sand on the effective well bottom.

9. The method of claim 8, wherein the effective well bottom is the effective total depth of the well at the time the sand placement operation begins.

10. The method of claim 8, wherein the effective well bottom is the top of a bridge plug set in the downhole pipe.

11. The method of claim 8 further comprising the additional step of placing a second plurality of sticks in the receiving pipe following the first plurality of sticks, the second plurality of sticks having a substantially finer mesh sand.

12. The method of claim 8, wherein the shape, solubility and density of the sand-bearing water-soluble sticks are such that the sticks are completely or substantially dissolved before reaching the intended depth of the top of the pipe interval to be filled.

13. The method of claim 8, wherein the shape, density and solubility of the sand-bearing water-soluble sticks are such that the sticks will descend through a column of salt water at a higher rate than unconsolidated sand alone.

14. The method of claim 8, wherein the sand-bearing water-soluble sticks are formed by combining sand with polyethylene glycol.

15. The method of claim 8, wherein the step of placing the plurality of sand-bearing water-soluble sticks in the receiving pipe further comprises:

attaching a stick insertion device to the well, the stick insertion device having a top valve, a middle portion having an interior for holding one or more sticks, and a bottom valve, the valves being sized for receiving the sticks when open, the insertion device being attached to the well such that the insertion device middle portion, interior is in fluid communication with the interior of the receiving pipe when the bottom valve is open;

separating the interior of the receiving pipe from the insertion device middle portion by closing the insertion device bottom valve; opening the insertion device top valve;

inserting one or more sticks through the insertion device top valve into the insertion device middle portion interior; closing the insertion device top valve;

opening the insertion device bottom valve, allowing the stick or sticks within the insertion device middle portion to fall into the interior of the receiving pipe; and repeating all post-insertion device attachment steps for additional sticks.

16. The method of claim 8 wherein the step of placing the plurality of sand-bearing water-soluble sticks in the receiving pipe further comprises:

a. isolating pressure from the receiving pipe interior from the surface by closing a receiving pipe valve located on or above the receiving pipe;

b. attaching a stick insertion device to the well, the stick insertion device having a top valve, a middle portion having an interior for holding one or more sticks, and a bottom valve, the valves being sized for receiving the sticks when open, the insertion device being attached such that the insertion device middle portion interior is in fluid communication with the interior of the receiving pipe when the bottom valve is open;

c. connecting the insertion device middle portion interior to the receiving pipe interior with a pressure equalization line, the pressure equalization line having a pressure equalization valve whereby such connection is closed when the pressure equalization valve is closed;

d. closing the pressure equalization valve;

e. separating the interior of the receiving pipe from the insertion device middle portion by closing the insertion device bottom valve;

f. opening the insertion device top valve, if closed;

g. inserting one or more sticks through the insertion device top valve into the insertion device middle portion interior;

h. closing the insertion device top valve;

i. opening the receiving pipe valve such that a pressure differential is created across the insertion device bottom valve;

j. opening the pressure equalization valve such that the pressure differential across the bottom valve is substantially eliminated;

k. closing the pressure equalization valve;

l. opening the insertion device bottom valve, allowing the stick or sticks within the insertion device middle portion to fall into the interior of the receiving pipe;

m. closing the insertion device bottom valve;

n. reducing the pressure within the insertion device middle portion to atmospheric pressure; and o. repeating steps f through n for additional sticks.

17. The method of claim 16 wherein the insertion device further comprises a middle portion bleed valve attached to the insertion device middle portion whereby pressure is released from the insertion device middle portion interior when the middle portion bleed valve is open, and further wherein the step of reducing the pressure within the insertion device middle portion to atmospheric pressure is accomplished by opening the middle portion bleed valve, followed by closing the middle portion bleed valve when the pressure has been so reduced.

18. The method of claim 16 wherein the connection made in the step of connecting the insertion device middle portion interior to the receiving pipe interior with a pressure equalization line, is indirectly made through other wellhead apparatus.

19. In the method of filling a portion of a downhole pipe having an effective well bottom with sand, where the interior of such pipe is in fluid communication with the interior of a receiving pipe at the surface, where the interiors of the downhole pipe and receiving pipe are connected by a pipe string, where water fills the portion of the downhole pipe which is to be filled and all or part of the connecting pipe string, and where an effective well bottom determines the lower depth of the portion of the downhole pipe to be filled, the improvement, comprising:

calculating the number of sand-bearing water-soluble sticks required to fill the desired interval in the downhole pipe;

adding one or more sticks to the calculated number, if desired, to accommodate for possible sand loss;

placing the above sum of sand-bearing water-soluble sticks in the interior of the receiving pipe; and waiting for the sticks to descend, dissolve and deposit the sand on the effective well bottom.

20. A sand-bearing water-soluble composition, comprising;

sand; and a water-soluble bonding agent, the combination of the sand and the bonding agent being a solid at standard temperature and pressure, the combination being shaped such that it may be received into and through a length of pipe, the shape, solubility and density of the composition being such that the composition will descend through a column of salt water in the pipe at a higher rate than the unconsolidated sand alone.

21. A sand-bearing water-soluble composition, comprising:

sand; and a water-soluble bonding agent, the combination of the sand and the bonding agent being a solid at standard temperature and pressure, the combination being shaped such that it may be received into and through a length of pipe, the bonding agent being polyethylene glycol.

22. A sand-bearing water-soluble composition, comprising:

sand; and a water-soluble bonding agent, the combination of the sand and the bonding agent being a solid at standard temperature and pressure, the combination being shaped such that it may be received into and through a length of pipe, the composition being colored to correspond with a particular size or grade of the pipe.

23. A sand-bearing water-soluble composition, comprising:

sand; and a water-soluble bonding agent, the combination of the sand and the bonding agent being a solid at standard temperature and pressure, the combination being shaped such that it may be received into and through a length of pipe, the composition being marked to correspond with a particular size or grade of the pipe.

* * * * *